US006320484B1

(12) United States Patent
Furuya et al.

(10) Patent No.: US 6,320,484 B1
(45) Date of Patent: Nov. 20, 2001

(54) HIGH FREQUENCY DIELECTRIC FILTER

(75) Inventors: Mitsuru Furuya, Tokyo; Yoshiyasu Yokoyama, Tochigi, both of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/449,885

(22) Filed: Nov. 30, 1999

(30) Foreign Application Priority Data

Nov. 30, 1998 (JP) ..... 10-339252

(51) Int. Cl.[7] ..... H01P 7/10; H01P 1/20; H01P 7/04

(52) U.S. Cl. ..... 333/219.1; 333/202; 333/222

(58) Field of Search ..... 333/202, 219, 333/219.1, 222

(56) References Cited

U.S. PATENT DOCUMENTS

| | | | | |
|---|---|---|---|---|
| 4,291,287 | * | 9/1981 | Young et al. | 333/210 |
| 4,613,838 | * | 9/1986 | Wada et al. | 333/232 |
| 4,639,699 | * | 1/1987 | Nishikawa et al. | 333/219 |
| 4,642,591 | * | 2/1987 | Kobayashi | 333/227 |
| 4,839,773 | * | 6/1989 | Ishikawa et al. | 333/202 |
| 6,175,286 | * | 1/2001 | Ueno | 333/219.1 |

FOREIGN PATENT DOCUMENTS

| | | |
|---|---|---|
| 63-250201 | 10/1988 | (JP) . |
| 63-266902 | 11/1988 | (JP) . |
| 6-34307 | 5/1994 | (JP) . |
| 11-68426 | 3/1999 | (JP) . |

OTHER PUBLICATIONS

Bandpass Filters Using™$_{010}$ Dielectric Rod Resonators, Yoshio Kobayashi and Shinichiro Yoshida, Department of Electrical Engineering, Saitama University, Urawa, Saitmam 338 Japan, IEEE 1978, p. 233 through 235.

* cited by examiner

*Primary Examiner*—Robert Pascal
*Assistant Examiner*—Patricia T. Nguyen
(74) *Attorney, Agent, or Firm*—Hutchins, Wheeler & Dittmar

(57) ABSTRACT

The present invention provides a high frequency dielectric filter which can realize high stability, the least loss of functionality, and mass-productiveness. In a high frequency dielectric filter adopting a TM mode, a resonator fixing plate 3 is used for fixing a dielectric resonator 2 and a case 1 and hence, they are firmly fixed both in the longitudinal direction and the lateral direction of the resonator. Accordingly, a high frequency dielectric filter which is stable against vibration and impact is provided.

9 Claims, 7 Drawing Sheets

HIGH FREQUENCY DIELECTRIC FILTER

BACKGROUND OF THE INVENTION

This invention relates to a high frequency (micro-wave) dielectric filter which uses a dielectric resonator.

The basic structure of a dielectric filter for use a TM (Transverse Magnetic) mode which is comprised of a metal case and a dielectric resonator is disclosed in a scholarly paper (Kobayashi et al.: IEEE MTT-S Digest, p 233–235 (1978)). In such a basic structure, however, the relative positional relationship between the dielectric resonator and the case is changed due to vibration and impact and hence, the characteristics of the dielectric filter is changed. Accordingly, such a dielectric filter is not practical.

Furthermore, in case the case and the dielectric resonator are fixed to each other by some methods, there is a chance that the quality factor is remarkably deteriorated and accordingly the dielectric filter is not usable in such a case.

In view of the above, conventionally, a method in which the case and the dielectric resonator are fixed to each other by means of a conductive paste or adhesive agent has been adopted.

The frequency band ranging from a few hundreds MHz to a few GHz has been widely used in various fields, chiefly in a mobile radio communication system. Here, the dielectric filter which works as a passive element is required to sustain little loss in quality and to be stable against the external environment.

The dielectric filter using the TM mode resonance is constructed such that a pillar-like dielectric has both ends thereof securely fixed to a metal case. It is indispensable that the dielectric filter has a relative positional relationship which does not change between the dielectric resonator and the case, and has highly stable against vibration and impact. From this point of view, there has been a practical problem that the conventional conductive paste or adhesive agent is less than optimal in terms of the stability, deterioration of the quality factor being likely to occur.

As described above, the fixing method which uses conductive paste or the adhering agent easily gives rise to dispersion by irregularities of the amount of coating of the dielectric filter. Therefore, the successful application of the fixing method largely depends on the experience of the workman and it is difficult to manufacture products of uniform characteristics. Furthermore, because of the poor reproducibility, it is not necessarily suitable the mass production.

SUMMARY OF THE INVENTION

To solve such a problem, a method which mechanically fixes the metal case and the dielectric resonator without using paste or the adhesive agent becomes necessary. The present invention has been made in view of the above background and it is an object of the present invention to provide a high frequency dielectric filter which exhibits high stability and suffers from the least loss against the vibration and the impact, by mechanically fixing the metal case and the dielectric resonator to each other.

It is another object of the present invention to provide a uniform and stable high frequency dielectric filter which can fix the metal case and the dielectric to each other easily and in a manner such that they can be separated later contrary to the conventional method which fixes the metal case and the dielectric resonator with the conductive paste or the adhering agent.

It is still another object of the present invention to provide a high frequency filter with the high reliability.

It is a further object of the present invention to provide a high frequency dielectric filter which has stable electric characteristics and which can be manufactured with the uniform electric characteristics.

It is a still further object of the present invention to provide a high frequency dielectric filter which can be manufactured on a mass production basis at a low cost.

The high frequency dielectric filter of the present invention is comprised of a dielectric resonator, a case provided with a plurality of first through holes, and a hollow resonator fixing plate.

The resonator fixing plate includes a second through hole at the center thereof, a plurality of third through holes around the second through hole, and at least two fourth through holes extending from the outer side surface thereof to the inner side surface thereof.

In the condition that the end portion of the dielectric resonator passes through the second thorough hole, resonator fixing screws are screwed into the fourth through holes from the outer peripheral surface to the inner peripheral surface and hence, the dielectric resonator is fixed to the metal case.

The resonator fixing plate is fixed to the case by screwing fixing plate fixing screws through the third through holes into the case.

BRIEF DESCRIPTION OF THE DRAWINGS

The accompanying drawings which are incorporated in and constitute a part of this specification, illustrate several embodiments of the invention and, together with the description, serve to explain the principles of this invention.

DESCRIPTION OF THE PREFERRED EMBODIMENT

Figure 1:
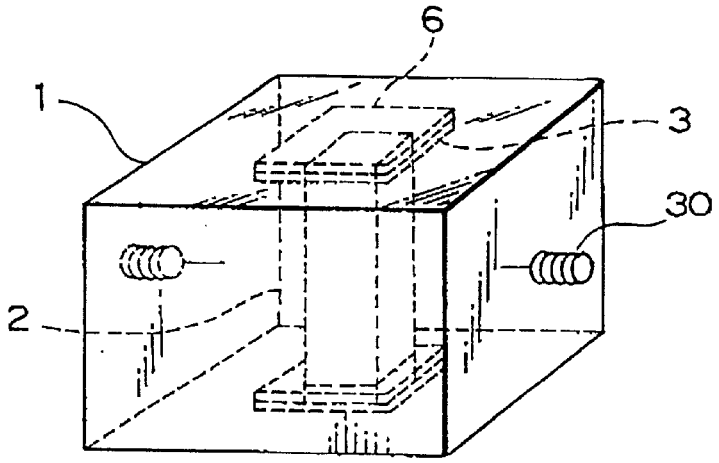
FIG. 1 is a view showing the basic structure of a high frequency dielectric filter (one stage) according to the present invention.
Figure 2A:
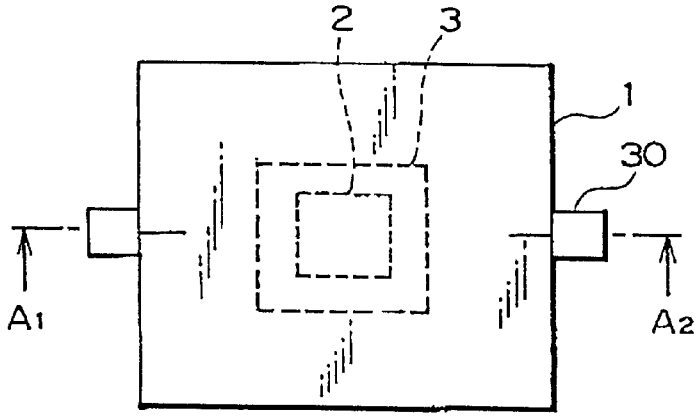
FIG. 2A is an overhead plane view of FIG. 1.
Figure 2B:
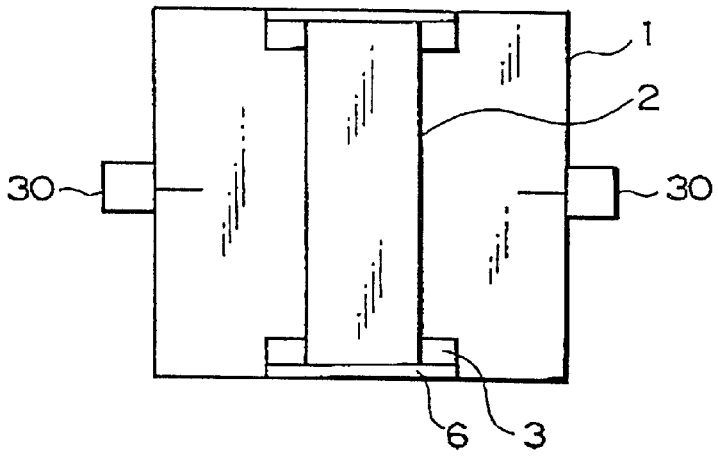
FIG. 2B is a cross sectional view of FIG. 2A taken along the line A1–A2.
Figure 3A:
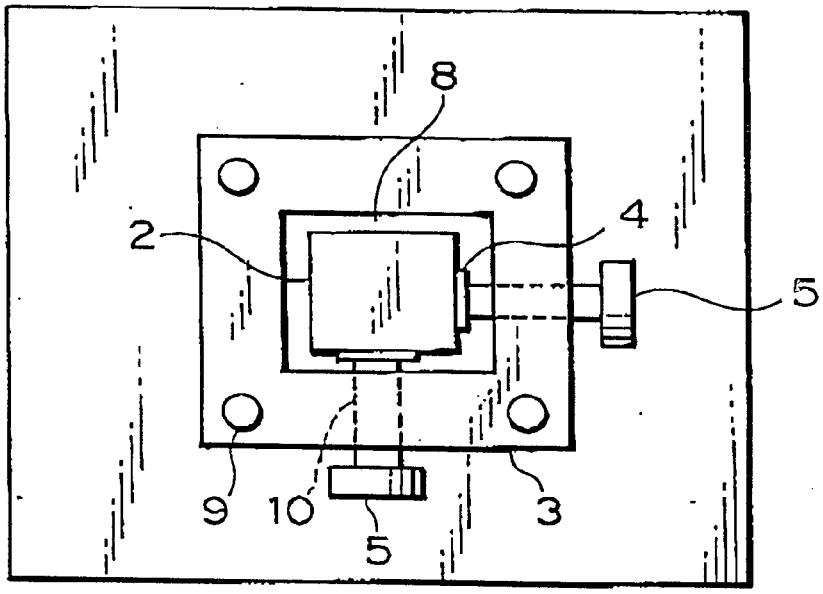
FIG. 3A is a view explaining the first embodiment in mounting a dielectric resonator to a case.
Figure 3B:
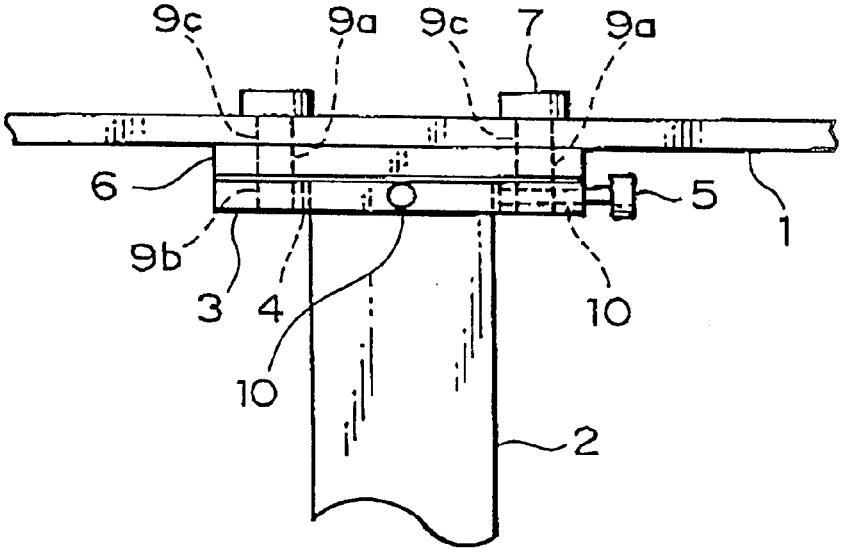
FIG. 3B is a front view of FIG. 3A.
Figure 4C:
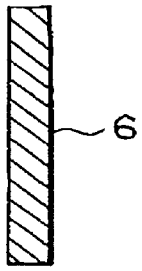
FIG. 4C is a cross sectional view of FIG. 4A taken along line A1–A2.
Figure 4A:
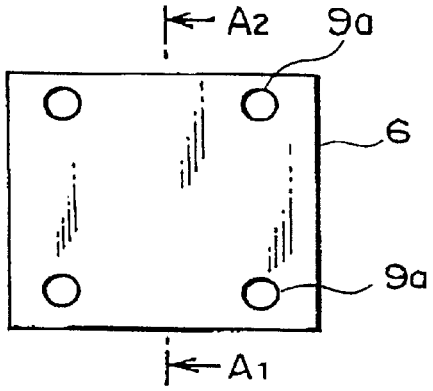
FIG. 4A is a view showing the structure of a spacer in FIG. 3A.
Figure 4B:
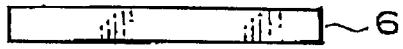
FIG. 4B is a front view of FIG. 4A.
Figure 5C:
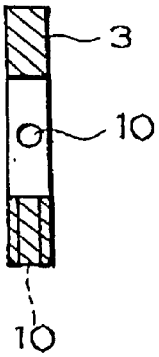
FIG. 5C is a cross sectional view of FIG. 5A taken along a line A1–A2.
Figure 5A:
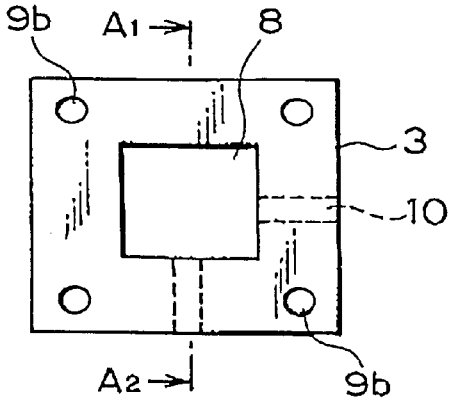
FIG. 5A is a view showing the structure of the resonator fixing plate in FIG. 3A.
Figure 5B:
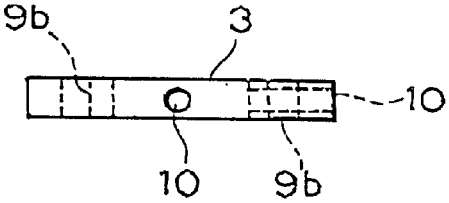
FIG. 5B is a front view of FIG. 5A.

The present invention of a high frequency dielectric filter focuses its attention on a method of fixing a dielectric resonator to a metal case and is constructed by fixing the dielectric resonator to the metal case using such a method. The first embodiment of the present invention is explained hereinafter in conjunction with FIG. 1–FIG. 5. FIG. 1 is a view showing the basic structure of a high frequency dielectric filter (one stage) according to the present invention. FIG. 2A is an overhead plane view of FIG. 1. FIG. 2B is a cross sectional view of FIG. 2A taken along line A1–A2. FIG. 3A is a view explaining the first embodiment in mounting a dielectric resonator to a case. FIG. 3B is a front view of FIG. 3A. FIG. 4A is a view showing the structure of a spacer in FIG. 3A. FIG. 4B is a front view of FIG. 4A. FIG. 4C is a cross sectional view of FIG. 4A taken along a line A1–A2. FIG. 5A is a view showing the structure of a resonator fixing plate in FIG. 3A. FIG. 5B is a front view of FIG. 5A. FIG. 5C is a cross sectional view of FIG. 5A taken along a line A1–A2.

To keep the dielectric resonator fixed against vibration and impact, the method for keeping the resonator from moving in a lateral direction relative to the longitudinal direction becomes important. As shown in FIG. 1 and FIG. 2, a metal case or a metal box body 1 is brought into close contact with both end surfaces of a pillar-like resonator 2 such that they are electrically short-circuited. Connectors 30 are mounted on both ends of the metal case 1. The dielectric resonator 2 and the metal case 1 are fixed to each other by means of a resonator fixing plate 3 which constitutes a fixing jig such that the relative positional relationship between the dielectric resonator 2 and the metal case 1 is not changed. The fixing jig may preferably be made of organic material or plastic, while the case may be a plastic case.

As shown in FIG. 3B, in the high frequency dielectric filter according to the embodiment, the resonator fixing plate 3 and the spacer 6 are disposed both at the upper surface and the lower surface of the metal case 1 in a laminated manner. As shown in FIG. 4A, through holes 9*a* are formed in the four corners of the spacer 6.

As shown in FIG. 5A, a through hole 8 is formed in the resonator fixing plate 3 such that the dielectric resonator 2 can pass through the through hole 8. In four corners of the resonator fixing plate 3, through holes 9*b* which have the same size as through holes 9*a* formed in the spacer 6 are formed for fixing the resonator fixing plate 3 to the metal case 1. Through holes 10 for fixing the dielectric resonator 2 to the resonator fixing plate 3 are formed in the fixing plate 3 such that the through holes 10 extend from the outer side surface (the outer periphery) to the inner side surface (the center hole 8).

As shown in FIG. 3B, through holes 9*c* which have the same size as the through holes 9*a*, 9*b* are formed in the metal case 1. A plastic case may be used in place of the metal case 1. One end portion of the dielectric resonator 2 is fixed to the resonator fixing plate 3 by passing the end portion through the through hole 8 and thereafter screwing resonator fixing screws 5 into the through holes 10 from a lateral direction. Here, to prevent the resonator fixing screws 5 from injuring the dielectric resonator 2, a spacer 4 is interposed between the resonator fixing screws 5 and the dielectric resonator 2. Then, fixing plate fixing screws 7 are screwed into through holes 9*a*, 9*b* by way of the metal case 1 so as to fix the resonator fixing plate 3 and the metal case 1 to each other. In this manner, by fixing the resonator fixing plate 3 and the spacer 6 which constitute plate-like jigs to the metal case 1, the dielectric resonator 2 can be firmly fixed to the metal case 1. In FIG. 3A, numeral 9 indicates a through hole formed of the through hole 9*c* of the metal case 1 and the through holes 9*a*, 9*b* in an aligned position.

Figure 6A:
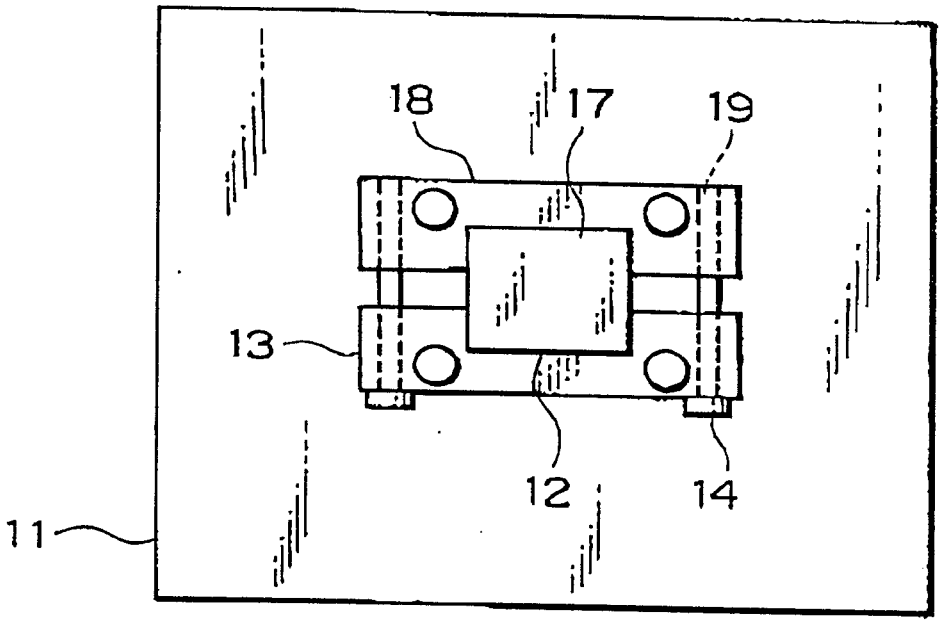
FIG. 6A is a view explaining the second embodiment in mounting a dielectric resonator to a case.
Figure 6B:
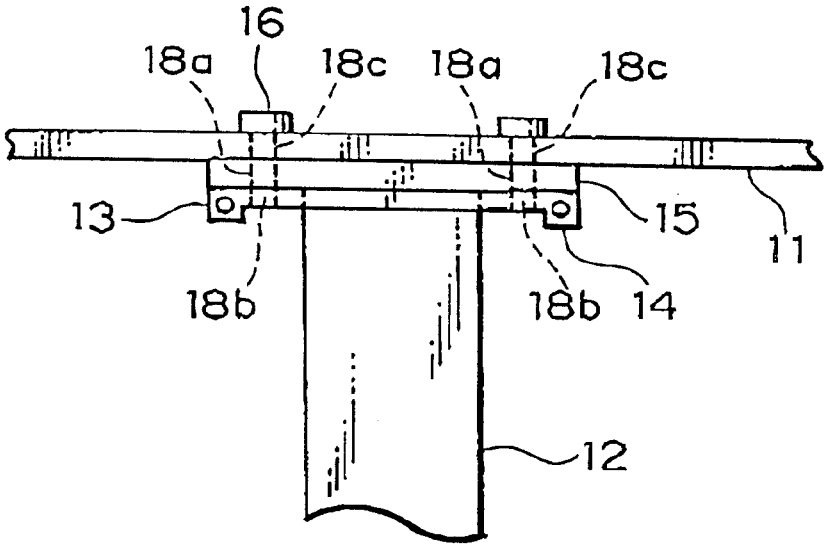
FIG. 6B is a front view of FIG. 6A.
Figure 7C:
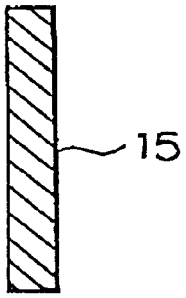
FIG. 7C is a cross sectional view of FIG. 7A taken along a line A1–A2.
Figure 7A:
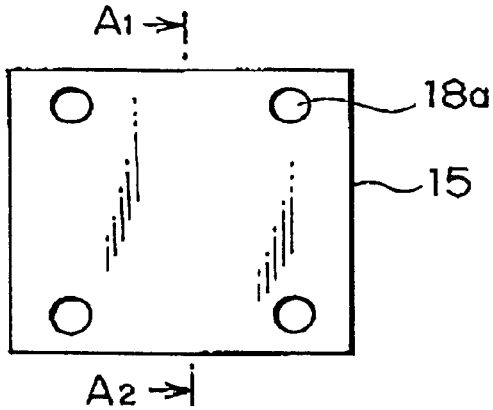
FIG. 7A is a view showing the structure of a spacer in FIG. 6A.
Figure 7B:
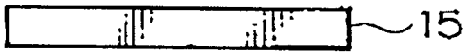
FIG. 7B is a front view of FIG. 7A.
Figure 8C:
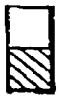
FIG. 8C is a cross sectional view of FIG. 8A taken along line A1–A2.
Figure 8A:
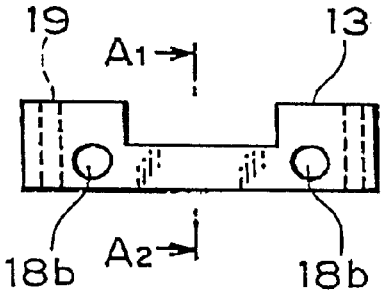
FIG. 8A is a view showing the structure of a resonator fixing plate in FIG. 6A.
Figure 8B:
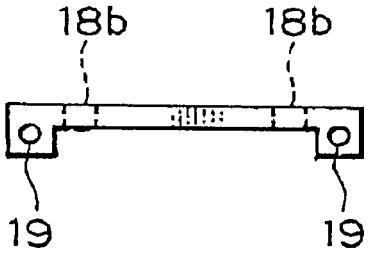
FIG. 8B is a front view of FIG. 8A.

Subsequently, the second embodiment of the present invention is explained in conjunction with FIG. 6 to FIG. 8. FIG. 6A is a view explaining the second embodiment in mounting a dielectric resonator to a case. FIG. 6B is a front view of FIG. 6A. FIG. 7A is a view showing the structure of a spacer in FIG. 6A. FIG. 7B is a front view of FIG. 7A. FIG. 7C is a cross sectional view of FIG. 7A taken along a line A1–A2. FIG. 8A is a view showing the structure of a resonator fixing plate in FIG. 6A. FIG. 8B is a front view of FIG. 8A. FIG. 8C is a cross sectional view of FIG. 8A taken along a line A1–A2.

This embodiment is characterized in that two plate-like jigs are used and the end portion of the dielectric resonator 12 is clamped from both sides, thus keeping the resonator rigid in a lateral direction. As shown in FIG. 6B, on the upper surface and the lower surface of the metal case 11, resonator fixing plates 13 and a spacer 15 are disposed respectively in a laminated form. In four corners of the spacer 15, as shown in FIG. 7A, thorough holes 18*a* are formed.

As shown in FIG. 6A, the through hole 17 is formed in the resonator fixing plate 13 such that a pillar-like dielectric resonator 12 passes through the through hole 17. Through holes 18*b* which have the same size as through holes 18*a* formed in the spacer 15 are formed in four corners of the resonator fixing plates 13 for fixing the resonator fixing plates 13 to the metal case 11. As shown in FIG. 6B, through holes 18*c* which have the same size as the through holes 18*a*, 18*b* are formed in the metal case 11. A plastic case may be used in place of the metal case 11. As shown in FIG. 8A, through holes 19 which extend from the outer surfaces to the inner side surface of the resonator fixing plates 13 are formed in the resonator fixing plates 13 for fixing the dielectric resonator 12 to the resonator fixing plates 13.

As shown in FIG. 6A, two sheets of plate-like jigs, that is, two resonator fixing plates 13 are fixed by means of the resonator fixing screws 14 such that the dielectric resonator 12 is clamped by the resonator fixing plates 13. Then, the fixing plate fixing screws 16 are screwed into the through holes 18*a*, 18*b* by way of the metal case 11 so as to fix the two resonator fixing plates 13 and the metal case 11 to each other. Due to such a construction, the dielectric resonator 12 is firmly fixed to the metal case 11. In FIG. 6A, numeral 18 indicates a thorough hole which is constituted by the through hole 18*c* of the metal case 11 and the through holes 18*a*, 18*b* in an aligned position.

Figure 9A:
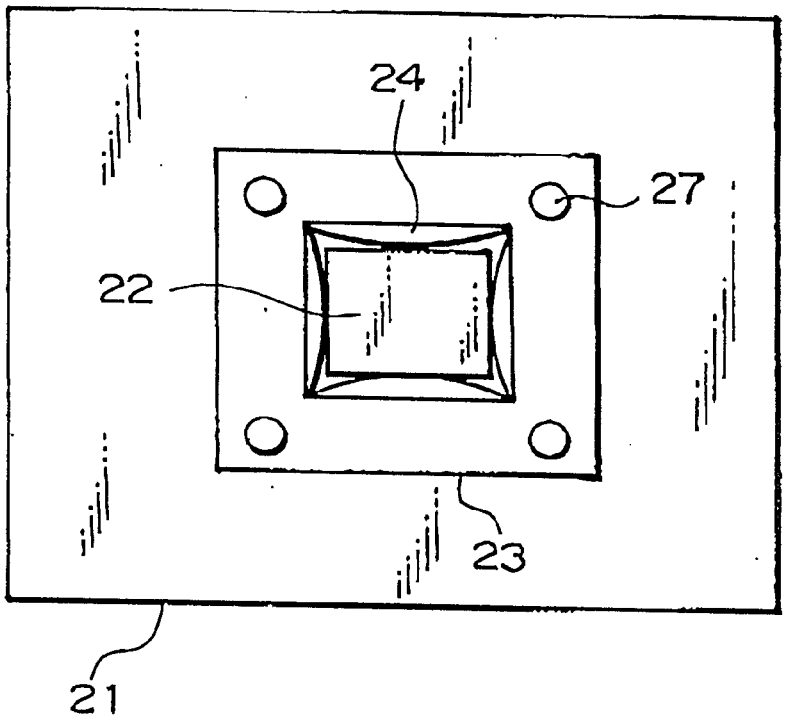
FIG. 9A is a view explaining the third embodiment in mounting a dielectric resonator to a case.
Figure 9B:
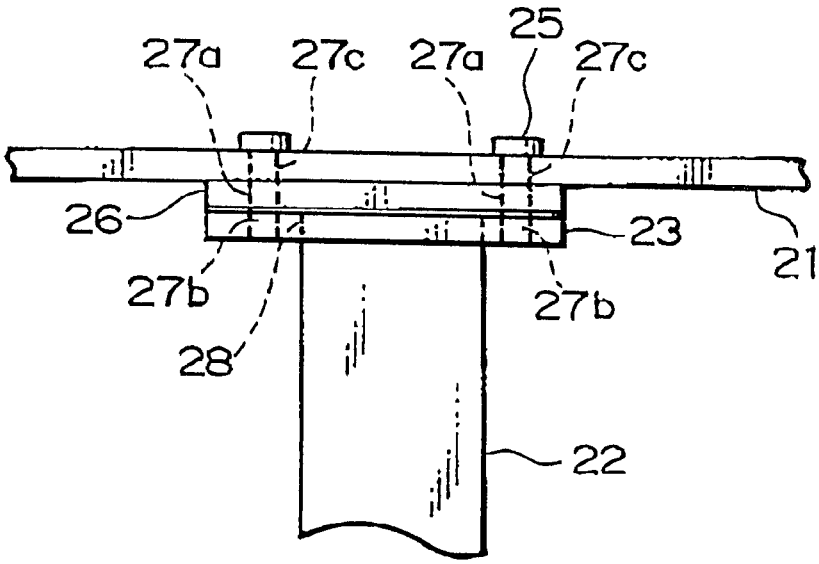
FIG. 9B is a front view of FIG. 9A.
Figure 10C:
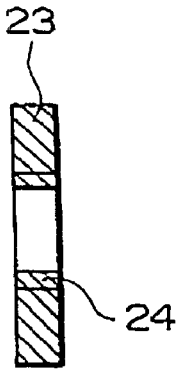
FIG. 10C is a cross sectional view of FIG. 10A taken along a line A1–A2.
Figure 10A:
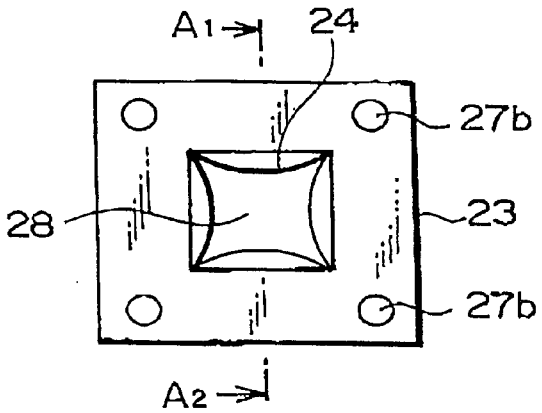
FIG. 10A is a view showing the structure of the resonator fixing plate in FIG. 9A.
Figure 10B:
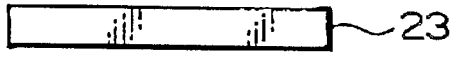
FIG. 10B is a front view of FIG. 10A.

The third embodiment of the present invention is explained in conjunction with FIG. 9 and FIG. 10. FIG. 9A is a view explaining the third embodiment in mounting a dielectric resonator to a case. FIG. 9B is a front view of FIG. 9A. FIG. 10A is a view showing the structure of the resonator fixing plate in FIG. 9A. FIG. 10B is a front view of FIG. 10A. FIG. 10C is a cross sectional view of FIG. 10A taken along a line A1–A2.

As shown in FIG. 10A, a through hole 28 through which a pillar-like dielectric resonator 22 passes is formed in a resonator fixing plate 23. As shown in FIG. 9A, through holes 27*a* are formed in four corners of a spacer 26. As shown in FIG. 9B, on an upper surface and a lower surface of metal case 21, a resonator fixing plate 23 and the spacer 26 are respectively disposed in a laminated form. Through holes 27*b* which have the same size as holes 27*a* formed in the spacer 26 are formed in four corners of the resonator fixing plate 23 so as to fix the resonator fixing plate 13 to the metal case 11. Through holes 27 which have the same size as the through holes 27*a*, 27*b* are formed in the metal case 21. A plastic case may be used in place of the metal case 21.

Spring plates 24 are provided to the inner peripheral surfaces of the through hole 28. The dielectric resonator 22 is fixed to the resonator fixing plate 23 by the reaction force of four spring plates 24 from four directions what the end portion of the dielectric resonator 22 is passed through the through hole 28. Thereafter, fixing plate fixing screws 25 are screwed into the through holes 27 by way of the metal case 21 and the spacer 26 so as to fix the resonator fixing plate 23 and the metal case 21 to each other. Due to such a fixing method, the dielectric resonator 22 can be firmly fixed to the metal case 21. In FIG. 9A, numeral 27 indicates a through hole which is constituted by the through hole 27*c* of the metal case 21 and the through holes 27*a*, 27*b* in an aligned position.

In the first embodiment, the metal case 1, the resonator fixing plate 3 and the spacer 6 are made of aluminum. The dielectric resonator 2 is made of dielectric material having a barium-based perovskite structure with a dielectric constant of 40.

The size of the metal case 1 which is used in a one stage filter which has the resonance center frequency set to approximately 1 GHz band is approximately 50 mm×50 mm ×50 mm. The size of the dielectric resonator 2 installed at the center of the metal case 1 is approximately 14 mm×14 mm×50 mm. On side surfaces of the metal case 1 which are disposed opposite to each other, probe connectors for excitation and detection are mounted. In case organic material or plastic is used as the material for the fixing jigs, polytetrafluoroethylene is preferably used.

In the second embodiment, the metal case 11, the resonator fixing plate 13 and the space 15 are made of aluminum. The dielectric resonator 12 is made of dielectric material having a barium-based perovskite structure with a dielectric constant of 40.

The size of the metal case 11 which is used in a one stage filter which has the resonance center frequency set to approximately 1 GHz band is approximately 50 mm×50 mm ×50 mm. The size of the dielectric resonator 12 installed at the center of the metal case 11 is approximately 14 mm×14 mm×50 mm. On side surfaces of the metal case 1 which are disposed opposite to each other, probe connectors for excitation and detection are mounted.

In the third embodiment, the metal case 21, the resonator fixing plate 23 and the spacer 26 are made of aluminum. The dielectric resonator 22 is made of dielectric material having a barium-based perovskite structure with a dielectric constant of 40.

The size of the metal case 21 which is used in one stage filter which has the resonance center frequency set to approximately 1 GHz band is approximately 50 mm×50 mm×50 mm. The size of the dielectric resonator 22 installed at the center of the metal case 21 is approximately 14 mm×14 mm×50 mm . On side surfaces of the metal case 21 which are disposed opposite to each other, probe connectors for excitation and detection are mounted.

Although the present invention is intended for utilization in a high frequency circuit of several hundred MHz to several GHz in the field of radio communication equipment, radar equipment, measuring equipment and the like, the frequency band to which the present invention is applicable is not specifically limited.

In case the quality factor is greatly decreased, that is, in case the loss is greatly increased with the provision of the above-mentioned fixing jigs, the fixing jigs are not practical. Accordingly, it is necessary to reduce the contact surface between these fitting jigs and the dielectric resonators as such as possible. The above-mentioned plate-like fitting jigs are effective in reducing the thickness of the fitting jigs as much as possible.

As described above, according to the present invention, the metal case and the dielectric resonator are mechanically fixed to each other by means of the fitting jig and hence, it becomes possible to construct a high frequency dielectric filter which is stable and suffers the least loss in functionality due to vibration and impact. Accordingly, the high frequency filters having uniform characteristics and high reliability in the frequency band from several hundred MHz to several GHz can be manufactured on a mass production basis.

Furthermore, since the present invention adopts the method in which the metal case and the dielectric resonator are mechanically fixed to each other by means of a fitting jig, an advantage that the manufacturing yield of the products is enhanced and the products having high precision are provided can be achieved.

What is claimed is:

1. A high frequency dielectric filter which utilizes a TM (Transverse Magnetic) mode, comprising:

a dielectric resonator;

a case which has a plurality of first through holes and which is fixed to the dielectric resonator;

a hollow resonator fixing plate which has a second through hole at a center thereof, a plurality of third through holes around the second through hole, and at least two fourth through holes extending from an outer peripheral surface thereof to an inner peripheral surface thereof;

resonator fixing screws which are screwed into the fourth through holes from the outer peripheral surface to the inner peripheral surface such that the dielectric resonator is fixed to the case, an end portion of the dielectric resonator passing through the second through hole; and fixing plate fixing screws which are screwed into the third through holes via the case so as to fix the resonator fixing plate to the case.

2. A high frequency dielectric filter as claimed in claim 1, wherein a first spacer is interposed between the resonator fixing plate and the case.

3. A high frequency dielectric filter as claimed in claim 2, wherein a second spacer is disposed between the dielectric resonator and the bottom end of the resonator fixing screw.

4. A high frequency dielectric filter as claimed in claim 1, wherein the thickness of the resonator fixing plate is not more than 1 cm.

5. A high frequency dielectric filter as claimed in claim 1, wherein the resonator fixing plate is made of one material selected from a group consisting of metal, plastic and polytetrafluoroethylene.

6. A high frequency dielectric filter as claimed in claim 1, wherein the case is made of either metal or plastic.

7. A high frequency dielectric filter as claimed in claim 1, wherein the resonator fixing screw is made of one material selected from a group consisting of metal, plastic and polytetrafluoroethylene.

8. A method for fixing a dielectric resonator consisting in a high frequency dielectric filter to a case, the method comprising the steps of:

disposing a hollow resonator fixing plate between both longitudinal end portions of the dielectric resonator and inner side surfaces of the case, forming a plurality of first through holes in the case, forming a plurality of second through holes in the periphery of the resonator fixing plate and at least two third through holes such that the third through holes extend from the outer periphery to the inner periphery of the resonator fixing plate, passing through the end portion of the dielectric resonator in the hollow portion of the resonator fixing plate screwing first fixing screws into the third through holes in a lateral direction so as to fix the dielectric resonator to the resonator fixing plate, and screwing second fixing screws through the first and the second through holes via the case so as to fix the resonator fixing plate and the case.

9. A high frequency dielectric filter as claimed in claim 8, wherein a first spacer is interposed between the resonator fixing plate and the case.

* * * * *